US008579598B2

(12) United States Patent
Konishi et al.

(10) Patent No.: US 8,579,598 B2
(45) Date of Patent: Nov. 12, 2013

(54) VARIABLE CAPACITY VANE PUMP

(75) Inventors: Hideo Konishi, Osato-gun (JP); Fusao Semba, Hiki-gun (JP); Shigeaki Yamamuro, Zushi (JP)

(73) Assignee: Hitachi, Ltd., Tokyo (JP)

( * ) Notice: Subject to any disclaimer, the term of this patent is extended or adjusted under 35 U.S.C. 154(b) by 648 days.

(21) Appl. No.: 12/678,056

(22) PCT Filed: Sep. 20, 2007

(86) PCT No.: PCT/JP2007/068237
§ 371 (c)(1),
(2), (4) Date: Mar. 12, 2010

(87) PCT Pub. No.: WO2009/037763
PCT Pub. Date: Mar. 26, 2009

(65) Prior Publication Data

US 2010/0303660 A1 Dec. 2, 2010

(51) Int. Cl.

| | |
|---|---|
| ***F04B 49/00*** | (2006.01) |
| ***F04B 1/06*** | (2006.01) |
| ***F04B 17/00*** | (2006.01) |
| ***F01C 21/18*** | (2006.01) |

(52) U.S. Cl.
USPC ..... 417/220; 417/219; 417/410.3; 418/30

(58) Field of Classification Search
USPC ..... 418/16; 417/220, 219
See application file for complete search history.

(56) References Cited

U.S. PATENT DOCUMENTS

| | | | | |
|---|---|---|---|---|
| 3,234,816 | A * | 2/1966 | Von Thuengen | 74/570.21 |
| 3,664,776 | A * | 5/1972 | Mills et al. | 418/16 |
| 4,598,612 | A * | 7/1986 | Ideta | 477/53 |
| 5,538,400 | A * | 7/1996 | Konishi et al. | 417/220 |
| 5,865,087 | A * | 2/1999 | Olson | 91/497 |
| 6,042,343 | A * | 3/2000 | Semba et al. | 417/220 |

(Continued)

FOREIGN PATENT DOCUMENTS

| | | |
|---|---|---|
| JP | 58-93978 A | 6/1983 |
| JP | 11-93856 A | 4/1999 |

(Continued)

OTHER PUBLICATIONS

Collins English Dictionary—Complete and Unabridged (c) HarperCollins Publishers 1991, 1994, 1998, 2000, 2003, http://www.thefreedictionary.com/pitch.*

(Continued)

*Primary Examiner* — Kenneth Bomberg
*Assistant Examiner* — Deming Wan
(74) *Attorney, Agent, or Firm* — Crowell & Moring LLP

(57) ABSTRACT

A variable capacity vane pump has a plurality of vanes radially extendably installed in their respective slots that are arranged in a circumferential direction in a rotor, a cam ring rockably provided on a supporting surface in a pump body and forming a plurality of pump chambers at an inner circumference side of the cam ring in cooperation with the rotor and the vanes, and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring. A center of the cam ring is offset to an inlet port side from a center of a driving shaft.

4 Claims, 7 Drawing Sheets

(56) References Cited

U.S. PATENT DOCUMENTS

| | | | | |
|---|---|---|---|---|
| 6,126,420 | A * | 10/2000 | Eisenmann | 418/19 |
| 6,280,150 | B1 | 8/2001 | Miyazawa | |
| 6,382,925 | B1 * | 5/2002 | Oba et al. | 417/220 |
| 6,503,068 | B2 * | 1/2003 | Kojima et al. | 418/30 |
| 6,790,013 | B2 * | 9/2004 | Hunter et al. | 417/220 |
| 6,932,588 | B2 * | 8/2005 | Choi et al. | 418/63 |
| 6,976,830 | B2 * | 12/2005 | Uchino | 417/220 |
| 2004/0156727 | A1 | 8/2004 | Uchino | |
| 2005/0019174 | A1 | 1/2005 | Uchino et al. | |
| 2005/0047938 | A1 * | 3/2005 | Konishi et al. | 417/410.3 |
| 2011/0268595 | A1 | 11/2011 | Yamamuro et al. | |

FOREIGN PATENT DOCUMENTS

| | | | |
|---|---|---|---|
| JP | 2003-74479 | A | 3/2003 |
| JP | 2005-42675 | A | 2/2005 |
| JP | 2006-322350 | A | 11/2006 |

OTHER PUBLICATIONS

International Search Report dated Oct. 16, 2007 with English Translation (Five (5) pages).

* cited by examiner

VARIABLE CAPACITY VANE PUMP

CROSS-REFERENCE TO RELATED APPLICATION

Cross-reference is made here to commonly assigned U.S. patent application Ser. No. 12/678,048, which is the U.S. national phase of international PCT application PCT/JP2007/068238, filed Mar. 12, 2010.

TECHNICAL FIELD

The present invention relates to a variable capacity pump, and more particularly to a variable capacity vane pump for power steering.

BACKGROUND ART

A conventional variable capacity vane pump which is disclosed in a Patent Document 1 controls a pump discharge amount by rocking a cam ring.

Patent Document 1: Japanese Patent Application Kokai Publication No. 11-93856

SUMMARY OF THE INVENTION

However, in the above conventional art technique, unlike a fixed capacity type pump, since this pump has an inlet port and an outlet port, pressure is in an unbalanced state in which a pressure of an outlet port side is greater. This outlet port side pressure acts on a rotor and a driving shaft, and bends and shifts the driving shaft to an inlet port side, then the driving shaft is offset. This shift causes a deviation of a relative position between the driving shaft and the cam ring. Therefore a delay of a start timing of compression occurs, and there is a problem that causes a decrease in pump efficiency and causes oscillation.

The present invention focuses attention on this problem, and an object of the present invention is to provide a variable capacity vane pump that is capable of reducing the decrease in pump efficiency and the oscillation.

In order to achieve the above object, in the present invention, a variable capacity vane pump comprises: a pump body; a driving shaft rotatably supported by the pump body; a rotor provided in the pump body and rotatably driven by the driving shaft; a plurality of vanes radially extendably installed in their respective slots that are arranged in a circumferential direction in the rotor; a cam ring rockably provided on a supporting surface in the pump body and forming a plurality of pump chambers at an inner circumference side of the cam ring in cooperation with the rotor and the vanes; first and second members provided at both sides in an axial direction of the cam ring; an inlet port provided at least one of the first and second members and opening to a section of the pump chamber where a volume of the pump chamber increases; an outlet port provided at least one of the first and second members and opening to a section of the pump chamber where the volume of the pump chamber decreases; and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring, and a center of the cam ring is offset to an inlet port side from a center of the driving shaft.

DETAILED DESCRIPTION

According to the present invention, it is possible to provide the variable capacity vane pump that reduces the decrease in pump efficiency and the oscillation which are caused by the offset-shift of the driving shaft.

In the following, the variable capacity vane pump of the present invention will be explained on the basis of embodiments shown in drawings.

Embodiment 1

Structure of Vane Pump

Figure 1:
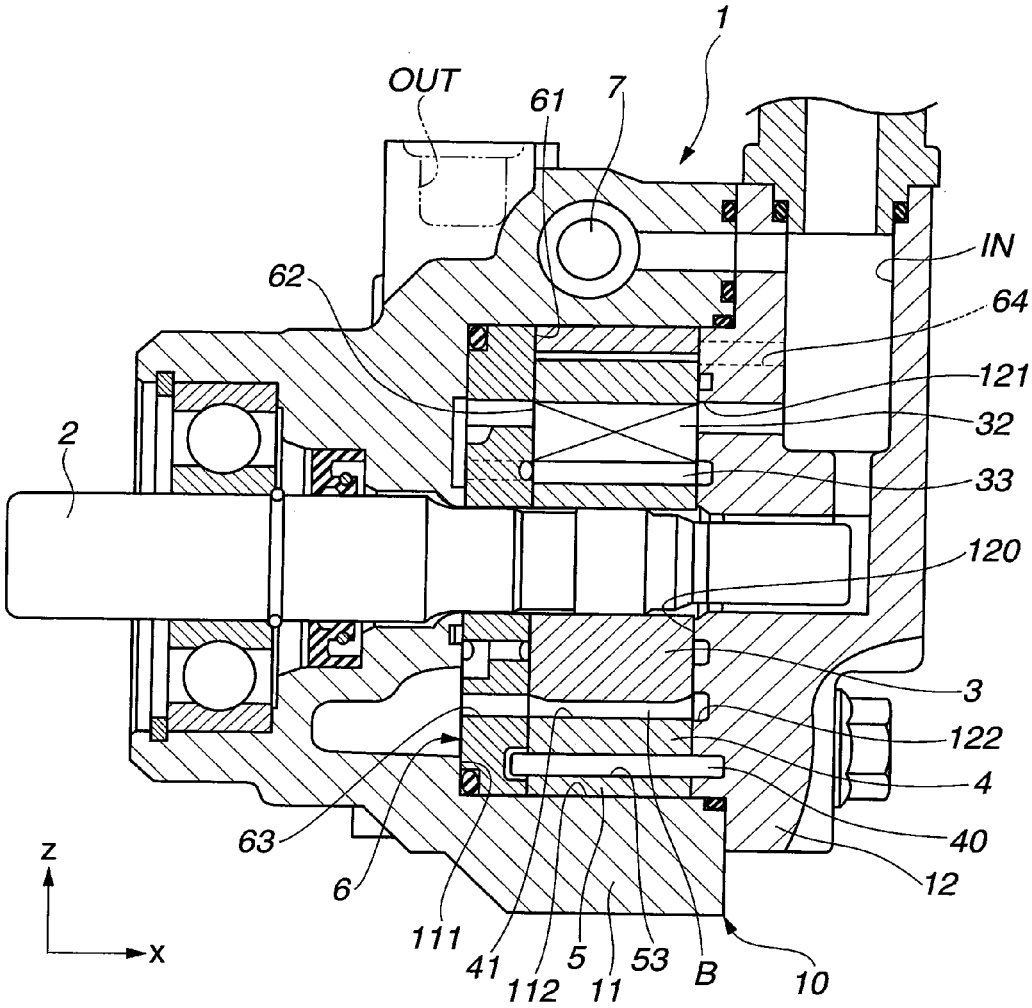
FIG. 1 is a sectional view in an axial direction of a vane pump according to an embodiment 1.
Figure 2:
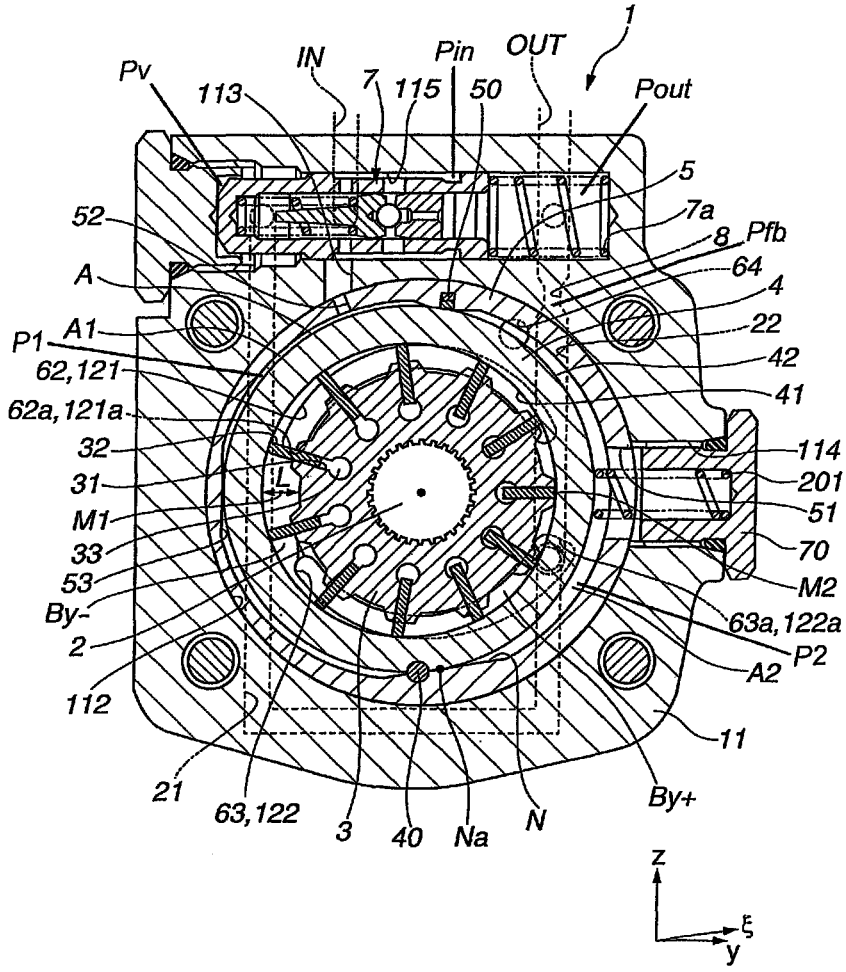
FIG. 2 is a sectional view in a radial direction of the vane pump according to the embodiment 1 (an eccentricity amount of a cam ring is a maximum).
Figure 3:
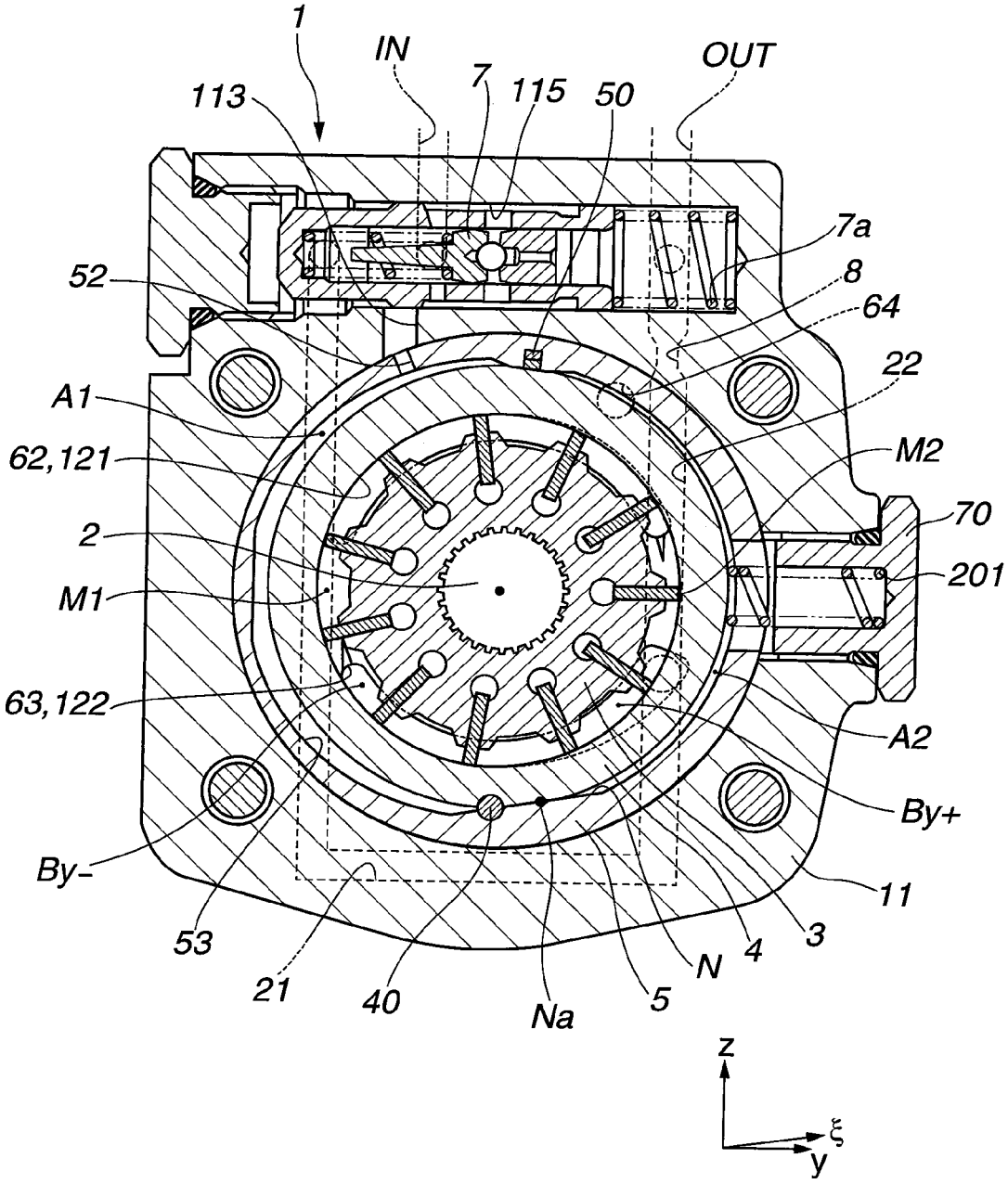
FIG. 3 is a sectional view in a radial direction of the vane pump according to the embodiment 1 (the eccentricity amount of the cam ring is a minimum).

An embodiment 1 will be explained on the basis of FIGS. 1 to 7. FIG. 1 is a sectional view in an axial direction of a vane pump 1. FIGS. 2 and 3 are sectional views in a radial direction of the vane pump 1. FIG. 2 shows a case where a cam ring 4 is positioned at an end in the negative direction of a y-axis (an eccentricity amount of the cam ring 4 is a maximum). FIG. 3 shows a case where the cam ring 4 is positioned at an end in the positive direction of the y-axis (the eccentricity amount of the cam ring 4 is a minimum).

Here, in the drawings, an axial direction of a driving shaft 2 is defined as an x-axis, and a direction in which the driving shaft 2 is inserted into first and second housings 11, 12 is positive direction of the x-axis. Further, an axial direction of a spring 201 that restrains a rock of the cam ring 4 is defined as the y-axis (see FIG. 2), and a direction in which the spring 201 forces the cam ring 4 is the negative direction of the y-axis. An axis orthogonal to the x-axis and the y-axis is a z-axis, and a direction where an inlet vent "IN" is located is positive direction of the z-axis.

The vane pump 1 has the driving shaft 2, a rotor 3, the cam ring 4, an adapter ring 5, and a pump body 10. The driving shaft 2 is connected to an engine through a pulley, and rotates integrally with the rotor 3.

A plurality of slots 31 are radially formed at the rotor 3 and arranged around a periphery of the rotor 3. This slot 31 is a groove formed in axial direction, and a vane 32 is provided in each slot 31. The vane 32 is inserted into the slot 31 so that the vane 32 can move or extend in radial direction. In an inner radial side end portion of each slot 31, a back-pressure chamber 33, in which a pressurized fluid is provided, is formed for forcing the vane 32 outwards in the radial direction by the pressurized fluid.

The pump body 10 is formed of a first housing 11 and a second housing 12 (a second member). The first housing 11 is formed into a cup-shape having a bottom, which opens to the positive direction of the x-axis. At a bottom portion 111 of the first housing 11, a disk shaped side plate 6 (a first member) is installed. The adapter ring 5, the cam ring 4 and the rotor 3 are accommodated in a pump element accommodation portion 112 that is an inner circumferential portion of the first housing 11, at the positive direction side of x-axis of the side plate 6.

The second housing 12 is in liquid-tight contact with the adapter ring 5, the cam ring 4 and the rotor 3 from the positive direction side of the x-axis. The adapter ring 5, the cam ring 4 and the rotor 3 are sandwiched between the side plate 6 and the second housing 12, and are held by these side plate 6 and second housing 12.

On an x-axis positive direction side surface 61 of the side plate 6 and on an x-axis negative direction side surface 120 of the second housing 12, inlet ports 62, 121 and also outlet ports 63, 122 are respectively provided. These inlet and outlet ports communicate with the inlet vent "IN" and an outlet vent "OUT" respectively, then supply and exhaust of working fluid for a pump chamber "B" that is formed between the rotor 3 and the cam ring 4 are done.

The adapter ring 5 is an oval-shaped ring member that is formed into a substantially oval whose y-axis is major (longer) axis and whose z-axis is minor axis. The adapter ring 5 is installed inside the first housing 11, and the cam ring 4 is installed inside the adapter ring 5. In order for the adapter ring 5 not to rotate in the first housing 11 during the pump drive, the rotation of the adapter ring 5 with respect to the first housing 11 is restrained by a pin 40.

The cam ring 4 is a ring shaped member that is formed into a substantially perfect circle, and its diameter is substantially equal to a diameter of an inner circumference of the minor axis of the adapter ring 5. Therefore, since the cam ring 4 is installed inside the oval-shaped adapter ring 5, a hydraulic pressure chamber "A" is defined between the inner circumference of the adapter ring 5 and an outer circumference of the cam ring 4 in a space outside the outer circumference of the cam ring 4. The cam ring 4 can therefore rock or tilt inside the adapter ring 5 in the y-axis direction.

A seal member 50 (a first seal member) is provided at a top end portion in the positive direction of the z-axis on an adapter ring inner circumferential surface 53. On the other hand, at a bottom end portion in negative direction of the z-axis on the inner circumferential surface 53, a supporting surface "N" is formed. The adapter ring 5 supports the cam ring 4 and stops a movement in the negative direction of the z-axis of the cam ring 4 by the supporting surface "N".

On the supporting surface "N", the pin 40 (a second seal member) is provided. The above mentioned hydraulic pressure chamber "A" between the cam ring 4 and the adapter ring 5 is divided into two hydraulic pressure chambers by this pin 40 and the seal member 50 at the negative and positive direction sides of the y-axis respectively, and a first hydraulic pressure chamber A1 and a second hydraulic pressure chamber A2 are defined.

Here, since the cam ring 4 rocks or tilts while rotating on the supporting surface "N", each capacity or volume of the first and second hydraulic pressure chambers A1, A2 is varied. However, the supporting surface "N" at the negative direction side of the z-axis is formed to be parallel to ξ-axis that is defined by rotating the y-axis in a counterclockwise direction with an origin point being a center. That is, the supporting surface "N" slants or slopes in the positive direction of the z-axis as the supporting surface "N" extends in the positive direction of the y-axis. And then, this sloping supporting surface "N" allows the cam ring 4 easily to rock or tilt in the negative direction of the y-axis.

Since an inlet pressure is supplied into the second hydraulic pressure chamber A2, a supporting force of the cam ring 4 by a second hydraulic pressure chamber A2 internal pressure cannot be sufficiently obtained. The cam ring 4 is then likely to tilt to a second hydraulic pressure chamber A2 side (the positive direction side of the y-axis). However, by setting a supporting position on the supporting surface "N" under a high rotation low pressure condition to be higher than that under a low rotation high pressure condition (by setting the supporting position under the high rotation low pressure condition to be on an inlet port 62, 121 side), the tilt of the cam ring 4 is prevented.

An outside diameter of the rotor 3 is smaller than that of a cam ring inner circumference 41 of the cam ring 4, and the rotor 3 is installed inside the cam ring 4. The rotor 3 is provided so that an outer circumference of the rotor 3 does not touch the cam ring inner circumference 41 even when the cam ring 4 rocks and a relative position between the rotor 3 and the cam ring 4 changes.

In a case where the cam ring 4 rocks and is positioned at the end in the negative direction of the y-axis inside the adapter ring 5, a distance "L" between the cam ring inner circumference 41 and the outer circumference of the rotor 3 becomes a maximum. On the other hand, in a case where the cam ring 4 is positioned at the end in the positive direction of the y-axis inside the adapter ring 5, the distance "L" becomes a minimum.

A length in the radial direction of the vane 32 is set to be longer than the maximum distance "L". Therefore, the vane 32 always touches the cam ring inner circumference 41 while being inserted in the slot 31 irrespective of the relative position between the rotor 3 and the cam ring 4. By this setting, the vane 32 always receives a back pressure from the back-pressure chamber 33, and the vane 32 liquid-tightly touches the cam ring inner circumference 41.

Accordingly, liquid-tight spaces between the cam ring 4 and the rotor 3 are always defined by the plurality of the adjacent vanes 32, and the pump chamber "B" is formed. Under a state where a center of the cam ring 4 shifts from a center of the rotor 3 by the rock of the cam ring 4 (i.e. the rotor 3 and the cam ring 4 are under an eccentric position), volume of each pump chamber "B" varies by the rotation of the rotor 3.

The inlet ports 62, 121 and the outlet ports 63, 122, respectively provided in the side plate 6 and the second housing 12, are formed along the outer circumference of the rotor 3, and the supply and exhaust of the working fluid are done by the volume change of the each pump chamber "B".

At an end portion in the positive direction of the y-axis of the adapter ring 5, a radial-direction penetration hole 51 is formed. Further, a plug member insertion hole 114 is formed at an end portion in the positive direction of the y-axis of the first housing 11. Then, a plug member 70 formed into a cup-shape having a bottom is inserted into the plug member insertion hole 114, and an inside of the pump is insulated from an outside of the first and second housings 11, 12 and the liquid-tight inside of the pump is maintained.

The previously mentioned spring 201 is inserted into the plug member 70, and is secured in an inner circumference of the plug member 70 so that the spring 201 is extendable and contractible in the y-axis direction. More specifically, the spring 201 penetrates the radial-direction penetration hole 51 of the adapter ring 5 and touches or contacts the cam ring 4, then forces the cam ring 4 in the negative direction of the y-axis.

The spring 201 is a spring that forces the cam ring 4 in the negative direction of the y-axis, in which an amount of the rock of the cam ring 4 becomes a maximum. Further, the spring 201 is the one that stabilizes the discharge amount (a rocking position of the cam ring 4) during a pump startup in which the pressure is not steady.

In the embodiment, an opening of the radial-direction penetration hole 51 of the adapter ring 5 acts as a stopper that limits the rock in the positive direction of the y-axis of the cam ring 4. However, the plug member 70 itself could penetrate the radial-direction penetration hole 51 and protrude from the inner circumference of the adapter ring 5, and then act as the stopper for limiting the rock in the positive direction of the y-axis of the cam ring 4.

[Supply of the Pressurized Fluid to First and Second Hydraulic Pressure Chambers]

A through hole 52 is provided at upper portion in the positive direction of the z-axis of the adapter ring 5, at a side of the seal member 50 in the negative direction of the y-axis. This through hole 52 communicates with a control valve 7 via an oil passage 113 that is provided inside the first housing 11. In addition, the through hole 52 communicates with the first hydraulic pressure chamber A1 formed at the negative direction side of the y-axis, then connects the first hydraulic pressure chamber A1 and the control valve 7. The oil passage 113 opens to a valve installation hole 115 that installs the control valve 7 therein, and a control pressure "Pv" is introduced into the first hydraulic pressure chamber A1 with the pumping action.

The through hole 52 provided at the adapter ring 5 is formed at a middle portion of adapter ring's width in the axis direction, so that an outer circumferential surface of the adapter ring 5 acts as a seal surface and leakage can be reduced.

The control valve 7 connects to the outlet ports 63, 122 through oil passages 21 and 22. An orifice 8 is provided on the oil passage 22, and an outlet pressure "Pout" that is an upstream pressure of the orifice 8 and a downstream pressure "Pfb" of the orifice 8 are introduced into the control valve 7. Then, the control valve 7 is driven by a pressure difference between these "Pout" and "Pfb" and a valve spring 7*a*, and the control pressure "Pv" is produced.

Thus, since the control pressure "Pv" is introduced into the first hydraulic pressure chamber A1 and this control pressure "Pv" is produced on the basis of an inlet pressure "Pin" and the outlet pressure "Pout", a relationship between the control pressure "Pv" and the inlet pressure "Pin" is; control pressure "Pv"≥inlet pressure "Pin".

On the other hand, the inlet pressure "Pin" is introduced into the second hydraulic pressure chamber A2 through a communication path 64. This communication path 64 is an oil path which communicates with the inlet vent "IN" and with the x-axis negative direction side surface 120 in the second housing 12 then connects the inlet vent "IN" and the second hydraulic pressure chamber A2. The communication path 64 always opens to the second hydraulic pressure chamber A2 irrespective of the rocking position of the cam ring 4.

Therefore, the second hydraulic pressure chamber A2 is supplied with the inlet pressure "Pin" all the time. With this, in the vane pump 1 of the present invention, only a fluid pressure P1 of the first hydraulic pressure chamber A1 is controlled. On the other hand, a fluid pressure P2 of the second hydraulic pressure chamber A2 is not controlled, and the fluid pressure P2 is equal to the inlet pressure "Pin" (P2=inlet pressure "Pin") all the time. With this, pressure leakage from the second hydraulic pressure chamber A2 side to the inlet port 62, 121 side is reduced, and the decrease in the pump efficiency is suppressed.

[Rocking of Cam Ring]

When a biasing force in the positive direction of the y-axis which the cam ring 4 receives from the pressure P1 of the first hydraulic pressure chamber A1 becomes greater than a biasing force in the negative direction of the y-axis which the cam ring 4 receives from the pressure P2 of the second hydraulic pressure chamber A2 and the spring 201, the cam ring 4 rocks in the positive direction of the y-axis with the pin 40 being a rotation center. A volume of a pump chamber By+ on the positive direction side of the y-axis increases by the rock of the cam ring 4, while a volume of a pump chamber By− on the negative direction side of the y-axis decreases.

When the volume of the pump chamber By− on the negative direction side of the y-axis decreases, an oil amount which is supplied from the inlet ports 62, 121 to the outlet ports 63, 122 in a unit time decreases, and the outlet pressure is reduced. With this reduction, the pressure P1 of the first hydraulic pressure chamber A1 into which the outlet pressure is introduced is also reduced. Then when the total biasing force in the negative direction of the y-axis becomes greater, the cam ring 4 rocks in the negative direction of the y-axis.

When both the biasing force in the positive direction of the y-axis and the biasing force in the negative direction of the y-axis substantially become equal to each other, the both forces in the y-axis direction, which act on the cam ring 4, balance out, then the cam ring 4 rests. When the outlet pressure is increased, the cam ring 4 rocks in the positive direction of the y-axis, and a position of a center of axis of the cam ring 4 becomes identical with that of the rotor 3. Then volumes of both pump chambers By+, By− on the positive and negative direction sides of the y-axis become equal to each other, and the pressure relationship is inlet pressure=outlet pressure=0.

With this, the pressure P1 of the first hydraulic pressure chamber A1 also becomes 0, and the cam ring 4 is forced in the negative direction of the y-axis by the biasing force F of the spring 201. In this way, the outlet pressure "Pout" is reset, and the eccentricity amount of the cam ring 4 is adjusted so that the pressure difference between the upstream and downstream of the discharge orifice is constant.

[Deviation of Positions Between Driving Shaft Center and Cam Ring Center]

Figure 4:
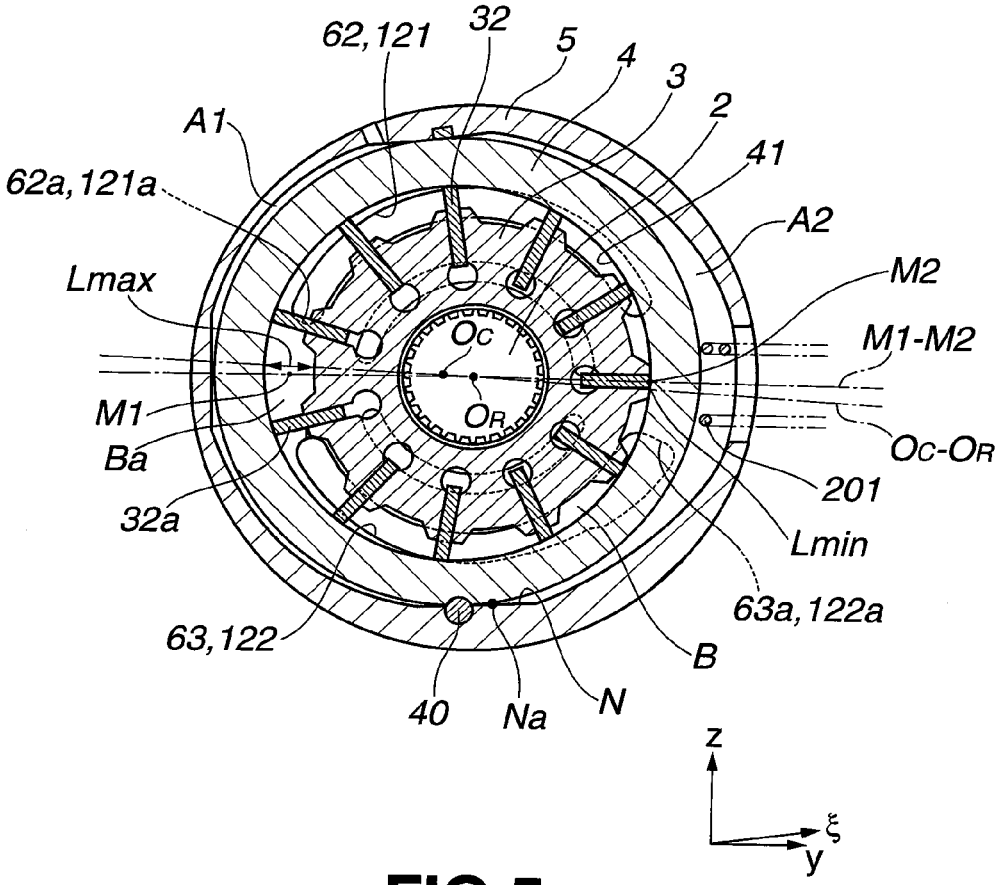
FIG. 4 is a sectional view of a part of the vane pump in a no-load state (in a no-pump-drive state).

FIG. 4 is a sectional view of a part of the vane pump 1 in a no-load state (in a no-pump-drive state). A center of the driving shaft 2 and the rotor 3 is defined as $O_R$, a center of the cam ring 4 is defined as $O_C$.

In the present embodiment, the cam ring center $O_C$ in the no-load state is set so that the cam ring center $O_C$ is positioned at the inlet port 62, 121 side (the positive direction side of the z-axis) as compared with the center $O_R$ of the driving shaft 2. The rotor 3 is forced from the negative direction side of the z-axis by the outlet pressure, and the driving shaft 2 is bent and shifted in the positive direction of the z-axis by this biasing force.

Thus, since the center $O_R$ of the driving shaft 2 shifts in the positive direction of the z-axis, the center $O_C$ of the cam ring 4 is previously offset to the positive direction side of the z-axis as compared with the driving shaft center $O_R$. More specifically, by slanting the supporting surface "N", a position in the z-axis direction of the cam ring 4 is set to be high. With this setting, even when the driving shaft 2 is bent and shifted by the outlet pressure during the pump drive, a stable discharge amount can be ensured (details will be explained later).

The cam ring inner circumference 41 and the outer circumference of the rotor 3 are substantially circular. Therefore when the cam ring center $O_C$ and the driving shaft center $O_R$ are identical with each other, the distance "L" between the cam ring inner circumference 41 and the outer circumference of the rotor 3 is uniformly equal throughout their circumferences.

When the center $O_C$ of the cam ring 4 shifts from the center $O_R$ of the rotor 3 and the driving shaft 2, the distance "L" between the cam ring inner circumference 41 and the outer circumference of the rotor 3 is not uniformly equal, and the distance "L" takes a maximum vale and a minimum value on an $O_C$-$O_R$ straight line.

The vane 32 is forced outwards in the radial direction by the pressure from the back-pressure chamber 33, therefore when the distance "L" varies, a protrusion amount of the vane 32 also varies. Because of this, the volume of the pump chamber "B" defined by the outer circumference of the rotor 3 and the cam ring inner circumference 41 and the vane 32 also varies depending on the distance "L".

That is to say, in a case of a position of the cam ring 4 where the distance "L" between the cam ring inner circumference 41 and the outer circumference of the rotor 3 is large, the volume of the pump chamber "B" is also large. In a case of the position of the cam ring 4 where the distance "L" is small, the volume of the pump chamber "B" is small. Consequently, at a point before and after the distance "L" becomes the maximum value Lmax on the $O_C$-$O_R$ straight line (at the negative direction side of the y-axis on the $O_C$-$O_R$ straight line) by the rotation of the rotor 3, the volume of the pump chamber "B" changes from the increase to the decrease. On the other hand, at a point before and after the distance "L" becomes the minimum value Lmin on the $O_C$-$O_R$ straight line (at the positive direction side of the y-axis on the $O_C$-$O_R$ straight line), the volume of the pump chamber "B" changes from the decrease to the increase.

Since the rotor 3 rotates in the counterclockwise direction, when a vane 32*a* of the eleven vanes 32 crosses the $O_C$-$O_R$ straight line at the negative direction side of the y-axis, a volume of a pump chamber Ba at the positive direction side of the z-axis from the $O_C$-$O_R$ straight line increases. However, when the vane 32 is positioned exactly on the $O_C$-$O_R$ straight line, the volume change becomes zero. And when the vane 32 is positioned on the negative direction side of the z-axis after crossing the $O_C$-$O_R$ straight line, the volume changes to the decrease.

That is, each time the vane 32*a* crosses the $O_C$-$O_R$ straight line at the negative direction side of the y-axis, the volume of the pump chamber Ba changes from the increase to the decrease. Likewise, each time the vane 32*a* crosses the $O_C$-$O_R$ straight line at the positive direction side of the y-axis, the volume of the pump chamber Ba changes from the decrease to the increase. With this, each time the vane 32 crosses the $O_C$-$O_R$ straight line, positive and negative of the volume change of the pump chamber "B" are switched.

[Port Reference Line]

Suction and discharge in the pump chamber "B" change between the inlet ports 62, 121 and the outlet ports 63, 122. Positions of the vane 32 at suction/discharge change point are first and second reference positions M1, M2. The first reference position M1 is positioned at the negative direction side of the y-axis, while the second reference position M2 is positioned at the positive direction side of the y-axis.

In the embodiment 1, a space between the adjacent vanes 32 is 1 pitch, and a position of the first reference position M1 is a half-pitch-advanced position from end edges 62*a*, 121*a* (edge portions of rotation direction of the rotor 3) of the inlet ports 62, 121. Likewise, a position of the second reference position M2 is a half-pitch-advanced position from end edges 63*a*, 122*a* (edge portions of rotation direction of the rotor 3) of the outlet ports 63, 122.

An M1-M2 line formed by these M1 and M2 is defined as a port reference line M1-M2. Thus in the embodiment 1, each time the vane 32*a* passes through this port reference line M1-M2, the suction and discharge of the pump chamber Ba are switched.

Because of this, a Z-axis positive direction side section Bz+, which is located on the positive direction side of the z-axis (the inlet port 62, 121 side) as compared with the port reference line M1-M2, is a suction section. A Z-axis negative direction side section Bz−, which is located on the negative direction side of the z-axis (the outlet port 63, 122 side) as compared with the port reference line M1-M2, is a discharge section.

Hence, in order to stabilize the discharge of the vane pump 1, it is desirable that the $O_c$-$O_R$ line on which the positive/negative of the volume change of the pump chamber "B" are switched and the port reference line M1-M2 on which the suction/discharge of the pump chamber B are switched should be as close as possible to each other. In particular, if the both lines are close to each other at the first reference position M1 that is the switch position from the suction to the discharge, the discharge amount is stable. Thus, it is desirable that the $O_C$-$O_R$ line and the port reference line M1-M2 should be as close as possible to each other and also as parallel as possible to each other.

[Relationship Between Port Reference Line and $O_C$-$O_R$ Line]

Figure 5:
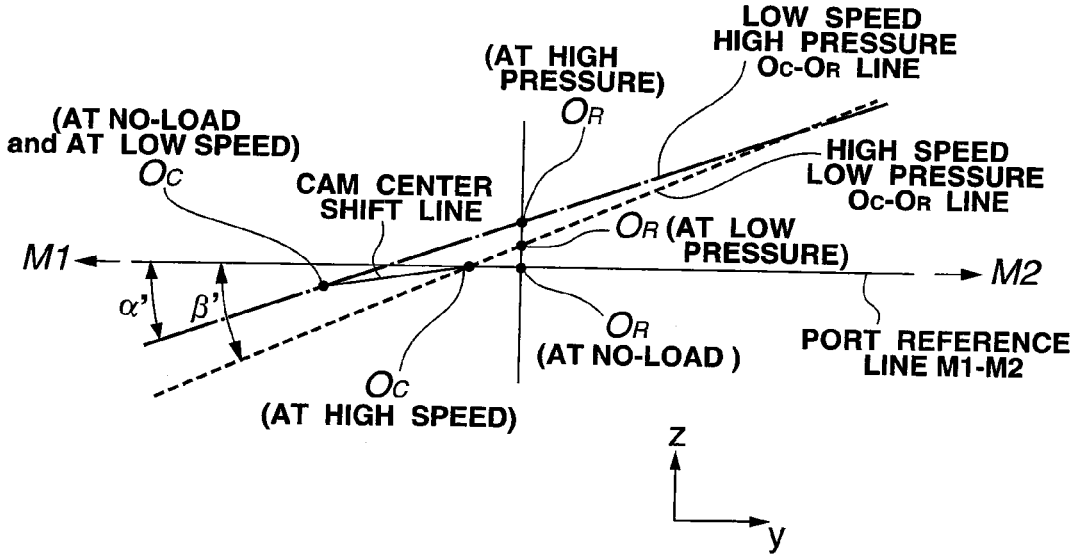
FIG.5 CONVENTIONAL ART
FIG. 5 is a schematic diagram showing a relationship between a port reference line M1-M2 and an $O_C$-$O_R$ line, of a conventional art.
Figure 6:
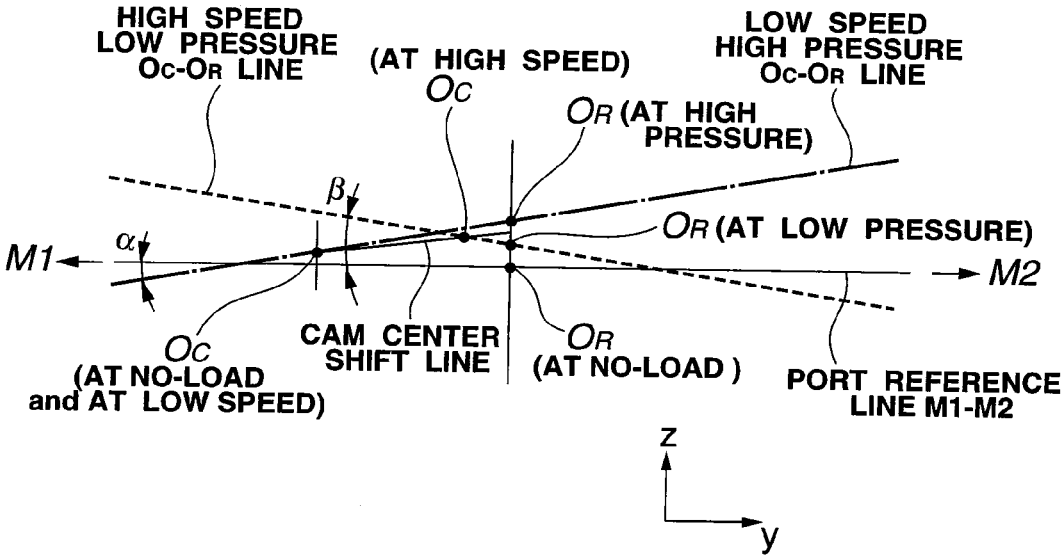
FIG. 6 is a schematic diagram showing a relationship between a port reference line M1-M2 and an $O_C$-$O_R$ line, of the embodiment 1 of the present invention.

FIGS. 5 and 6 are schematic diagrams showing a relationship between the port reference line M1-M2 and the $O_c$-$O_R$ line. FIG. 5 is a conventional art (positions of the center $O_C$ of the cam ring 4 and the center $O_R$ of the driving shaft 2 in the no-load state (in the no-pump-drive state) is shown). FIG. 6 is the embodiment 1 (a case where the cam ring center $O_C$ is positioned at the positive direction side of the z-axis as compared with the port reference line M1-M2 in the no-load state is shown).

Here, in the drawings, a thick solid line is the port reference line M1-M2, a thick alternate long and short dash line is the $O_C$-$O_R$ line under a pump high pressure condition, and a thick broken line is the $O_C$-$O_R$ line under a pump low pressure condition.

The cam ring center $O_C$ shifts in the y-axis direction by the rock of the cam ring 4. Then at the no-load and at the maximum eccentricity at which a speed is a low speed (see FIG. 2), the cam ring center $O_C$ is widely offset from the driving shaft center $O_R$ in the negative direction of the y-axis. On the other hand, at a high speed, the eccentricity amount of the cam ring 4 is small and an offset amount of the cam ring center $O_C$ is also small. However, the cam ring center $O_C$ is still offset from the driving shaft center $O_R$.

Here, when the pump 1 is driven and the pressure is produced in the pump chamber "B", the Z-axis negative direction side section Bz− becomes the high pressure, while the Z-axis positive direction side section Bz+ becomes the low pressure, with the port reference line M1-M2 being a boundary in the pump chamber "B", and the pressure difference therefore occurs.

By this pressure difference, the rotor 3 is forced in the positive direction of the z-axis together with the driving shaft 2, and the driving shaft 2 is elastically bent in the positive direction of the z-axis. The center $O_R$ of the driving shaft 2 also shifts to the positive direction side of the z-axis due to this elastic deformation, then the deviation between the cam ring center $O_C$ and the driving shaft center $O_R$ appears. A deviation amount becomes great at the high pressure, while it becomes small at the low pressure.

As a consequence, due to the elastic deformation of the driving shaft 2 by the outlet pressure, each of the $O_C$-$O_R$ lines at the high pressure and at the low pressure widely slopes with respect to the port reference line M1-M2. Angles of the $O_C$-$O_R$ lines at the high pressure and at the low pressure with respect to the port reference line M1-M2, are α', β'. α' and β' are both large, and thus the $O_C$-$O_R$ line and the port reference line M1-M2 are positioned away from each other at the first and second reference positions M1, M2 at which the suction/discharge are switched, and this results in an unstable discharge.

On the other hand, in the embodiment 1 of the present invention, the cam ring center $O_C$ is previously offset to the positive direction side of the z-axis (the inlet port 62, 121 side) from the driving shaft center $O_R$. For this reason, even when the driving shaft 2 is bent by the outlet pressure and driving shaft center $O_R$ shifts to the positive direction side of the z-axis, the $O_C$-$O_R$ line does not widely slope with respect to the port reference line M1-M2.

With this setting, an angle α defined by the $O_C$-$O_R$ line and the port reference line M1-M2 during the pump drive becomes smaller than the α' of the conventional art (i.e. α<α'), and the $O_C$-$O_R$ line and the port reference line M1-M2 become close to parallel. Under the high pressure condition, at the first and second reference positions M1, M2 at which the suction/discharge are switched, the $O_C$-$O_R$ line becomes close to the port reference line M1-M2. Consequently, a discharge amount fluctuation at the switch of the suction/discharge becomes small, thereby stabilizing the discharge.

Effect of the Embodiment 1

A variable capacity vane pump comprises the pump body 10; the driving shaft 2 rotatably supported by the pump body 10; the rotor 3 provided in the pump body 10 and rotatably driven by the driving shaft 2; a plurality of vanes 32 radially extendably installed in their respective slots 31 that are arranged in a circumferential direction in the rotor 3; the cam ring 4 rockably provided on the supporting surface N in the pump body 10 and forming a plurality of pump chambers B at the inner circumference 41 side of the cam ring 4 in cooperation with the rotor 3 and the vanes 32; the side plate 6 and the second housing 12 provided at both sides in the x-axis direction of the cam ring 4; the inlet port 62; 121 provided at least one of the side plate 6 and the second housing 12 and opening to a section of the pump chamber where a volume of the pump chamber increases; the outlet port 63; 122 provided at least one of the side plate 6 and the second housing 12 and opening to a section of the pump chamber where the volume of the pump chamber decreases; and the seal member 50 provided at an outer circumference side of the cam ring 4 and defining the first hydraulic pressure chamber A1 located at a side where the pump discharge amount increases and the second hydraulic pressure chamber A2 located at a side where the pump discharge amount decreases in the space (the hydraulic pressure chamber A) outside the outer circumference of the cam ring 4, and the center $O_C$ of the cam ring 4 is offset to the inlet port 62; 121 side (the positive direction side of the z-axis) from the center $O_R$ in the no-load state of the driving shaft 2.

With this, at the switch of the suction/discharge under the high pressure condition, the discharge amount fluctuation becomes small, and the decrease in the pump efficiency and the oscillation can be suppressed with the stable discharge.

The space between the adjacent vanes 32 is 1 pitch, and the center $O_C$ of the cam ring 4 is offset to the inlet port 62, 121 side from the port reference line M1-M2 that connects the half-pitch-advanced position from the end edges of the inlet ports 62, 121 in the rotation direction of the rotor 3 (i.e. in the counterclockwise direction in FIGS. 2 to 6) and the half-pitch-advanced position from the end edges of the outlet ports 63, 122 in the rotation direction of the rotor 3.

With this, the angle defined by the $O_C$-$O_R$ line and the port reference line M1-M2 during the pump drive becomes smaller than that of the conventional art, and the $O_C$-$O_R$ line and the port reference line M1-M2 become close to parallel. And, at the first and second reference positions M1, M2 at which the suction/discharge are switched, the $O_C$-$O_R$ line becomes close to the port reference line M1-M2. Accordingly, the discharge amount fluctuation at the switch of the suction/discharge becomes small and the discharge is stable, and therefore the decrease in the pump efficiency and the oscillation can be suppressed.

In the following, a modification example of the embodiment 1 will be described.

Embodiment 1-1

Figure 7:
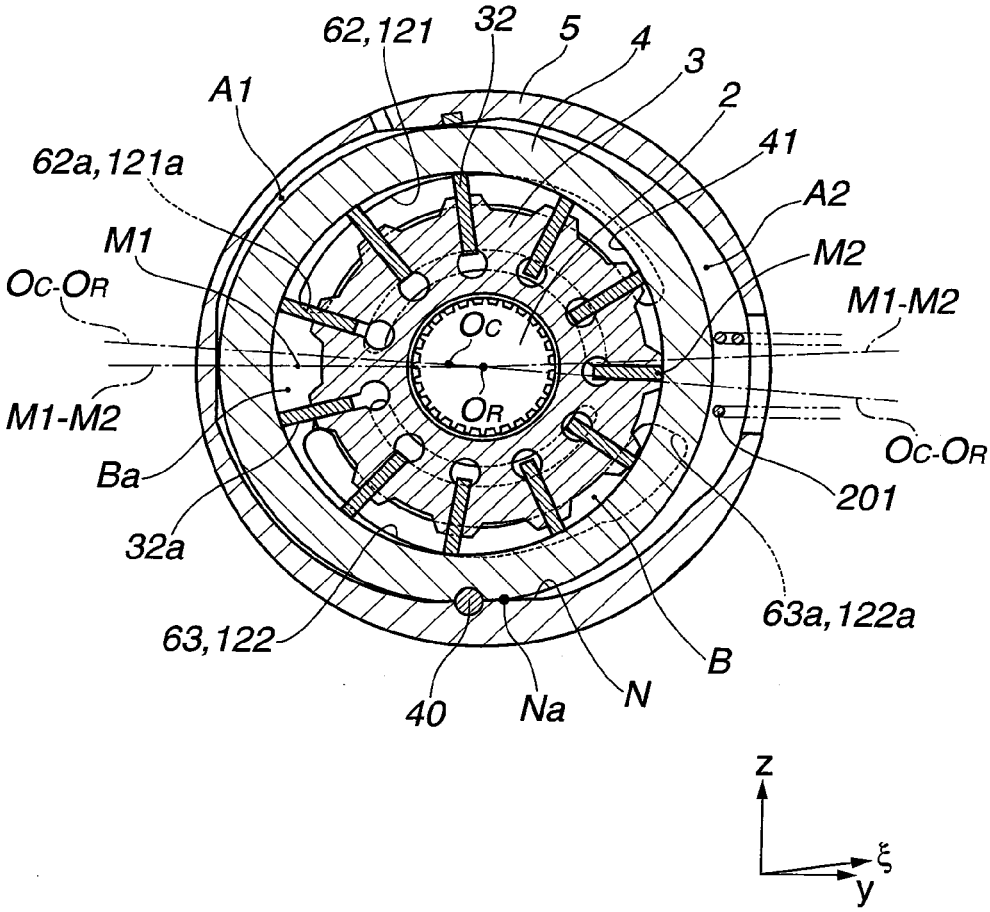
FIG. 7 is a sectional view of the part of the vane pump according to an embodiment 1-1.

FIG. 7 is an example in which the definition of the port reference line is changed. In the embodiment 1, the first and second reference positions M1, M2 at which the suction/discharge are switched and the driving shaft center $O_R$ are positioned on the one straight line. However, in the embodiment 1-1, a case where these are not positioned on the one straight line is shown.

The center $O_C$ of the cam ring 4 is offset to the inlet port 62, 121 side from a port reference line M1-M2 which connects the center $O_R$ of the driving shaft 2 in the no-load state and the first reference position M1 that is the half-pitch-advanced position from the end edges 62*a*, 121*a* of the inlet ports 62, 121 or the second reference position M2 that is the half-pitch-advanced position from the end edges 63*a*, 122*a* of the outlet ports 63, 122.

With this setting, the same working and effects as the embodiment 1 can be obtained. In the embodiment 1-1, since an M1-$O_R$-M2 line is a bent line, an M1-$O_R$ line or an M2-$O_R$ line is the port reference line. By properly changing the definition of the port reference line according to the characteristic of the vane pump 1, an optimum discharge performance can be gained. Here, the M1-$O_R$-M2 line of the bent line could be the port reference line as it is.

Embodiment 2

Embodiment 2 will be explained on the basis of FIGS. 8 and 9. The basic structure of the embodiment 2 is the same as the embodiment 1. In the embodiment 1, the cam ring center $O_C$ is only set on the positive direction side of the z-axis as compared with the port reference line M1-M2, and an angle of the supporting surface "N" supporting the cam ring 4 at the negative direction side of the z-axis is not limited.

In contrast to this, the embodiment 2 is different from the embodiment 1 in that an angle γ of the supporting surface "N" is provided. However, the cam ring center $O_C$ in the no-load state is set at the positive direction side of the z-axis (the inlet port 62, 121 side) as compared with the port reference line M1-M2 (including the driving shaft center $O_R$). This point is same as the embodiment 1.

Figure 8:
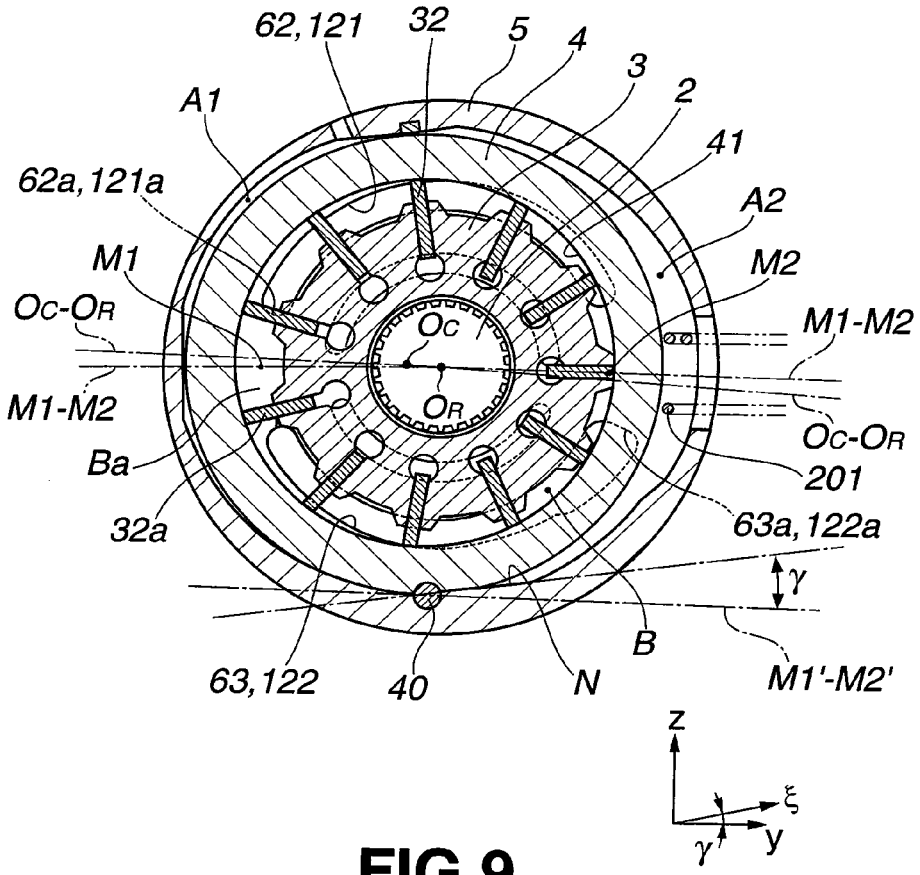
FIG. 8 is a sectional view of the part of the vane pump according to an embodiment 2.

FIG. 8 is a sectional view of the part of the vane pump 1 according to the embodiment 2. FIG. 9 is a schematic diagram showing a relationship between the port reference line M1-M2 and the $O_C$-$O_R$ line. In the embodiment 2, the supporting surface "N" slopes in the positive direction of the z-axis as the supporting surface "N" extends in the positive direction of the y-axis, and the angle γ with respect to the port reference line M1-M2 is set to 2°~8° (in FIG. 8, M1'-M2' is a straight line that passes through the pin 40 and is parallel to the M1-M2).

Figure 9:
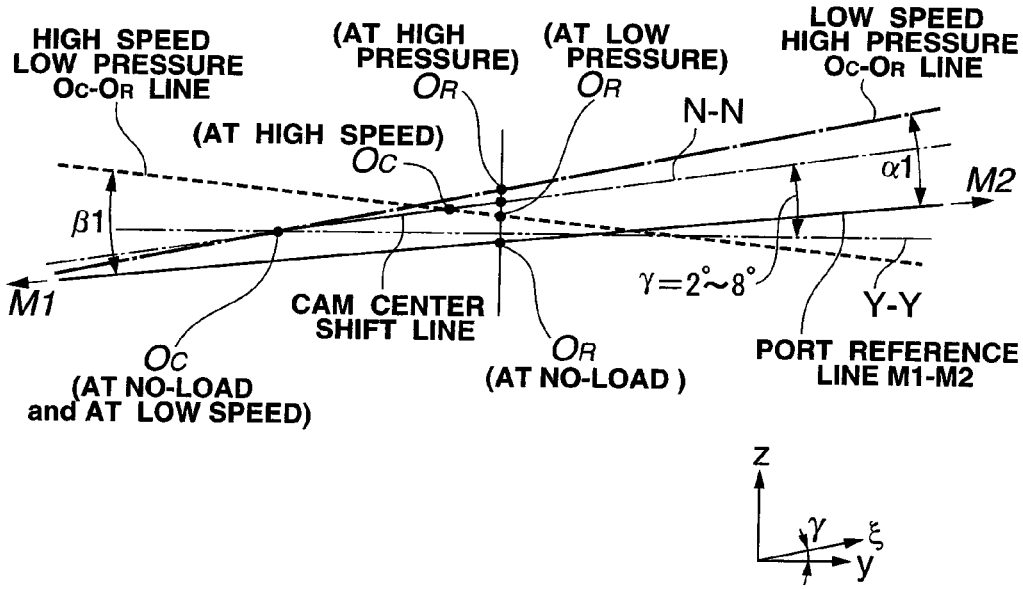
FIG. 9 is a schematic diagram showing a relationship between a port reference line M1-M2 and an $O_C$-$O_R$ line, of the embodiment 2.

In addition, in FIG. 9, a thin alternate long and short dash line N-N is a straight line that is parallel to the supporting surface "N" of the cam ring 4. A thin alternate long and two short dashes line Y-Y is a straight line that is parallel to the y-axis. Therefore, the cam ring 4 rocks along the N-N straight line. And as same as the supporting surface "N", the N-N straight line is parallel to the ξ-axis, and its angle with respect to the Y-Y straight line becomes γ.

The angle γ of the supporting surface "N" is designed normally by 360°/(the number of vanes×4). The angle of the supporting surface "N" of the present vane pump 1 having 11 vanes is approximately 8° by the normal design (see FIG. 10).

Figure 10:
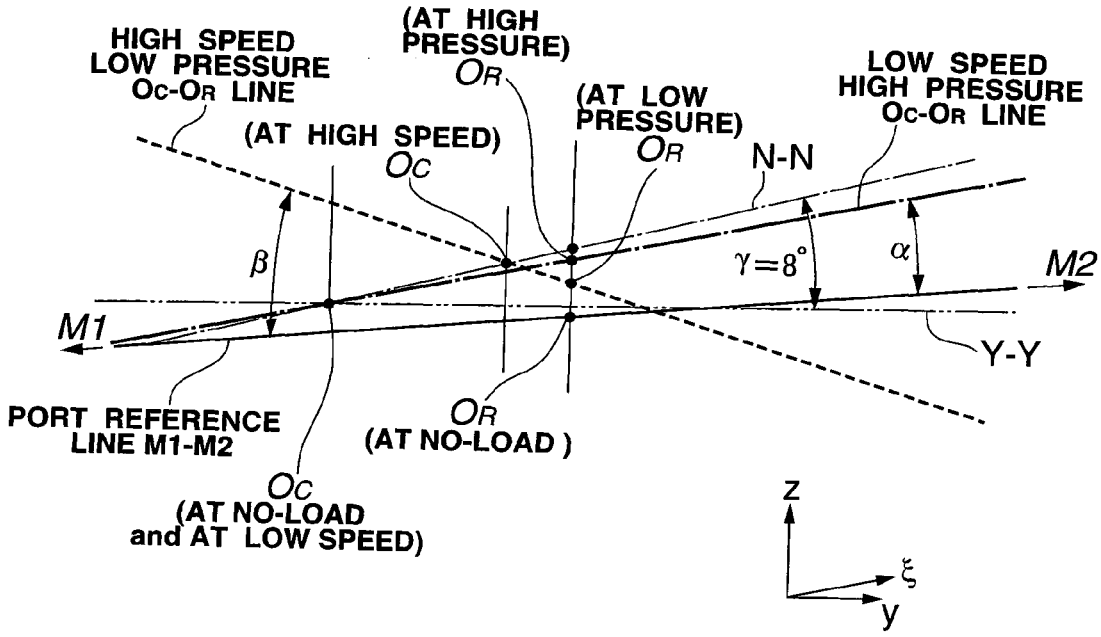
FIG. 10 is a schematic diagram showing a relationship between a port reference line M1-M2 and an $O_C$-$O_R$ line, before applying the embodiment 2 to the conventional art.

In FIG. 10, an inclination angle of the supporting surface "N" of this case is large, and the position in the positive direction of the z-axis of the cam ring 4 in the high speed state becomes high. With this, the position of the cam ring center $O_C$ is Widely offset from the driving shaft center $O_R$ in the positive direction of the z-axis.

Under the high pressure condition, since the driving shaft center $O_R$ widely shifts to the positive direction side of the z-axis, an angle α1 between a low speed high pressure $O_C$-$O_R$ line that connects the cam ring center $O_C$ and the driving shaft center $O_R$ and the M1-M2 line is not much changed. However, under the low pressure condition, with regard to an angle β1 between a high speed low pressure $O_C$-$O_R$ line and the M1-M2 line, since the shift amount of the driving shaft center $O_R$ is small, the positions of the center $O_C$ and the center $O_R$ are still separated in the z-axis direction (the embodiment 2, see FIG. 9).

Because of this, although the inclination angle α of the $O_C$-$O_R$ line with respect to the port reference line M1-M2 in the high pressure state becomes small and becomes parallel, the inclination angle β in the low pressure state becomes large. Thus, the first and second reference positions M1, M2 at which the suction/discharge are switched and the $O_C$-$O_R$ line are widely separated from each other, then the pump discharge becomes unstable.

As a consequence, in the embodiment 2, the angle γ of the supporting surface "N" with respect to the port reference line M1-M2 is set to be low, and its range is 2°~8°. With this setting, the height in the z-axis direction of the cam ring 4 becomes low, and the position in the z-axis direction of the cam ring center $O_C$ also becomes low (FIG. 9).

The cam ring center $O_C$ in the no-load state is set on the positive direction side of the z-axis as compared with the port reference line M1-M2, and the cam ring center $O_C$ becomes closer to the port reference line M1-M2 by an amount equivalent to the low setting of the angle γ of the supporting surface "N".

Therefore, even in a case where the pump outlet pressure is low and the driving shaft center $O_R$ does not much shift to the positive direction side of the z-axis, since the cam ring center $O_C$ is previously positioned close to the port reference line M1-M2, the positions in the z-axis direction of the center $O_C$ and the center $O_R$ are not widely separated from each other, and the inclination angle β1 of the $O_C$-$O_R$ line with respect to the port reference line M1-M2 in the low pressure state in the embodiment 2 becomes smaller than the low pressure inclination angle β in the embodiment 1 (β1<β).

With this, even at the low pressure where the z-axis positive direction shift amount of the driving shaft center $O_R$ is small, the $O_C$-$O_R$ line becomes close to the first and second reference positions M1, M2 at which the suction/discharge are switched, and the pump discharge amount at the low pressure becomes stable.

As previously mentioned, the cam ring center $O_C$ in the no-load state is set at the positive direction side of the z-axis (the inlet port 62, 121 side) as compared with the port reference line M1-M2 (including the driving shaft center $O_R$), and this point is same as the embodiment 1. Thus, also at the high pressure, the inclination angle α1 of the $O_C$-$O_R$ line with respect to the port reference line M1-M2 becomes small, and the stability of the pump discharge amount at the high pressure is maintained.

Further, since the inlet pressure is supplied into the second hydraulic pressure chamber A2, the supporting force of the cam ring 4 by the second hydraulic pressure chamber A2 internal pressure cannot be sufficiently obtained. The cam ring 4 is then likely to tilt to the second hydraulic pressure chamber A2 side. However, by limiting the angle of the supporting surface "N" within the range of 2°~8°, the tilt of the cam ring 4 is prevented more effectively.

Effect of the Embodiment 2

In the embodiment 2, the range of the angle γ of the supporting surface "N" with respect to the port reference line M1-M2 is set to 2°~8°. With this, even at the low pressure where the z-axis positive direction shift amount of the driving shaft center $O_R$ is small, it is possible to stabilize the pump discharge amount.

Although the invention has been described above by reference to certain embodiment of the invention, the invention is not limited to the embodiment described above. Further, design changes or engineering-change based on the embodiment are also included in the invention.

The invention claimed is:

1. A variable capacity vane pump comprising:

a pump body;

a driving shaft rotatably supported by the pump body;

a rotor provided in the pump body and rotatably driven by the driving shaft;

a plurality of vanes radially extendably installed in their respective slots that are arranged in a circumferential direction in the rotor;

a cam ring rockably provided on a supporting surface in the pump body and forming a plurality of pump chambers at an inner circumference side of the cam ring in cooperation with the rotor and the vanes, an eccentricity amount of the cam ring with respect to the rotor being changed by rotating of the cam ring on the supporting surface;

first and second members provided at both sides in an axial direction of the cam ring;

an inlet port provided at least at one of the first and second members and opening to a suction section of the pump chamber where a volume of the pump chamber increases;

an outlet port provided at least at one of the first and second members and opening to a discharge section of the pump chamber where the volume of the pump chamber decreases; and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring, wherein a center of the cam ring is provided (i) so as to be positioned at an inlet port side with respect to a center of the driving shaft in a no-load state in which a pressure difference between the suction section and the discharge section does not act on the driving shaft and the rotor, and (ii) so as to be positioned at an outlet port side with respect to the center of the driving shaft in a state in which the driving shaft is elastically deformed to the inlet port side by the action of the pressure difference on the driving shaft.

2. The variable capacity vane pump as claimed in claim 1, wherein the second hydraulic pressure chamber is supplied with at least an inlet pressure.

3. The variable capacity vane pump as claimed in claim 1, wherein a line on which suction/discharge of the pump chamber are switched is defined as a port reference line, and the supporting surface is provided so that the supporting surface gradually separates from the port reference line in a direction from the second hydraulic pressure chamber to the first hydraulic pressure chamber.

4. The variable capacity vane pump as claimed in claim 1, wherein a range of an angle between the supporting surface and the port reference line is 2°~8°.

* * * * *